US009685695B2

(12) United States Patent
Sugimoto et al.

(10) Patent No.: US 9,685,695 B2
(45) Date of Patent: Jun. 20, 2017

(54) ANTENNA SYSTEM AND ANTENNA UNIT

(71) Applicant: DENSO CORPORATION, Kariya, Aichi-pref. (JP)

(72) Inventors: Yuji Sugimoto, Kariya (JP); Tadao Suzuki, Kariya (JP); Yasumune Yukizaki, Okazaki (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 59 days.

(21) Appl. No.: 14/507,081

(22) Filed: Oct. 6, 2014

(65) Prior Publication Data

US 2015/0097738 A1 Apr. 9, 2015

(30) Foreign Application Priority Data

Oct. 7, 2013 (JP) ..... 2013-210328
May 21, 2014 (JP) ..... 2014-105556

(51) Int. Cl.
*H01Q 1/32* (2006.01)
*H01Q 7/00* (2006.01)
*H01Q 21/24* (2006.01)

(52) U.S. Cl.
CPC ..... *H01Q 1/3275* (2013.01); *H01Q 7/00* (2013.01); *H01Q 21/24* (2013.01)

(58) Field of Classification Search
CPC .. H01Q 1/1214; H01Q 1/3208; H01Q 1/3275; H01Q 7/00; H01Q 21/24
USPC ..... 343/711, 712, 713
See application file for complete search history.

(56) References Cited

U.S. PATENT DOCUMENTS

2004/0227677 A1* 11/2004 Asano ..... G06F 1/1616 343/702
2007/0279304 A1* 12/2007 Chakam ..... H01Q 1/088 343/713
2011/0122039 A1 5/2011 Baba et al.

FOREIGN PATENT DOCUMENTS

JP 2003318624 A * 11/2003
JP 2004-179921 A 6/2004
JP 2010-004318 1/2010
JP 2012054915 A * 3/2012
JP 2013-009140 1/2013

OTHER PUBLICATIONS

Office Action mailed Oct. 20, 2015 in the corresponding JP application No. 2014-105556 with English translation.

* cited by examiner

*Primary Examiner* — Dieu H Duong
(74) *Attorney, Agent, or Firm* — Harness, Dickey & Pierce, P.L.C.

(57) ABSTRACT

An antenna system includes a case, an antenna configured for a first communication system, an inside orthogonal antenna configured for a polarization diversity communication system, and an outside orthogonal antenna configured for the polarization diversity communication system. The antenna for the first communication system and the inside orthogonal antenna are disposed inside the case such that a main radiation polarization plane of the inside orthogonal antenna is orthogonal to a main radiation polarization plane of the antenna for the first communication system. The outside orthogonal antenna is disposed outside the case such that a main radiation polarization plane of the outside orthogonal antenna is orthogonal to the main radiation polarization plane of the inside orthogonal antenna.

16 Claims, 7 Drawing Sheets

ANTENNA SYSTEM AND ANTENNA UNIT

CROSS REFERENCE TO RELATED APPLICATIONS

The present application is based on and claims priority to Japanese Patent Application No. 2013-210328 filed on Oct. 7, 2013 and Japanese Patent Application No. 2014-105556 filed on May 21, 2014, the contents of which are incorporated in their entirety herein by reference.

TECHNICAL FIELD

The present disclosure relates to an antenna system including a plurality of antennas and an antenna unit used for the antenna system.

BACKGROUND

An antenna system corresponding to multiple types of communication systems and including multiple antennas is known. When the multiple antennas respectively corresponding to the multiple communication systems are disposed adjacent to each other, radio wave interference between the communication systems causes a problem.

In an antenna apparatus disclosed in JP-A-2010-004318 (corresponding to US 2011/0122039 A1), a radiation element of one antenna and a radiation element of the other antenna are disposed in a twisted relationship so that isolation of two antennas used for two communication systems is secured.

In other words, in the antenna apparatus disclosed in JP-A-2010-004318, the one antenna is disposed in a plane orthogonal to a substrate while being inclined 45 degrees with respect to the substrate. The other antenna is disposed in a plane orthogonal to the substrate and apart from the plane including the one antenna while being inclined 45 degrees in a direction opposite from the one antenna.

When one of communication systems is a communication system using a polarization diversity (hereafter, referred to as a polarization diversity communication system), it is required not only to enhance isolation between multiple communication systems but also to secure a communication performance of the polarization diversity communication system.

SUMMARY

An object of the present disclosure is to provide an antenna system that can enhance isolation between multiple communication systems and can secure a communication performance of a polarization diversity communication system. Another object of the present disclosure is to provide an antenna unit used for the antenna system.

An antenna system according to a first aspect of the present disclosure includes a case, an antenna configured for a first communication system, an inside orthogonal antenna configured for a polarization diversity communication system used for a second communication system, and an outside orthogonal antenna configured for the polarization diversity communication system. The antenna for the first communication system and the inside orthogonal antenna are disposed inside the case such that a main radiation polarization plane of the inside orthogonal antenna is orthogonal to a main radiation polarization plane of the antenna for the first communication system. The outside orthogonal antenna is disposed outside the case such that a main radiation polarization plane of the outside orthogonal antenna is orthogonal to the main radiation polarization plane of the inside orthogonal antenna.

In the antenna system, the inside orthogonal antenna disposed inside the same case with the antenna for the first communication system is disposed such that the main radiation polarization plane of the inside orthogonal antenna is orthogonal to the main radiation polarization plane of the antenna for the first communication system. Thus, even when the case is small and the antenna for the first communication system and the inside orthogonal antenna are disposed adjacent to each other, isolation between the antennas can be enhanced. Therefore, isolation between the first communication system and the second communication system can be enhanced, and radio wave interference between the communication systems can be suppressed.

In addition, because the outside orthogonal antenna is disposed outside the case, the outside orthogonal antenna is not restricted concerning a size of the case. Thus, when the outside orthogonal antenna is disposed apart from the antenna for the first communication system, isolation between the outside orthogonal antenna and the antenna for the first communication system can be enhanced. Furthermore, because the outside orthogonal antenna is disposed such that the main radiation polarization plane of the outside orthogonal antenna is orthogonal to the main radiation polarization plane of the inside orthogonal antenna, a communication performance of the polarization diversity communication system can be secured.

An antenna unit according to a second aspect of the present disclosure includes a case, an antenna configured for a first communication system, and an inside orthogonal antenna configured for a polarization diversity communication system used for a second communication system. The antenna for the first communication system and the inside orthogonal antenna are disposed inside the case such that a main radiation polarization plane of the inside orthogonal antenna is orthogonal to a main radiation polarization plane of the antenna for the first communication system.

The antenna unit can be used for the antenna system according to the first aspect.

BRIEF DESCRIPTION OF THE DRAWINGS

Additional objects and advantages of the present disclosure will be more readily apparent from the following detailed description when taken together with the accompanying drawings. In the drawings.

DETAILED DESCRIPTION

First Embodiment

Figure 1:
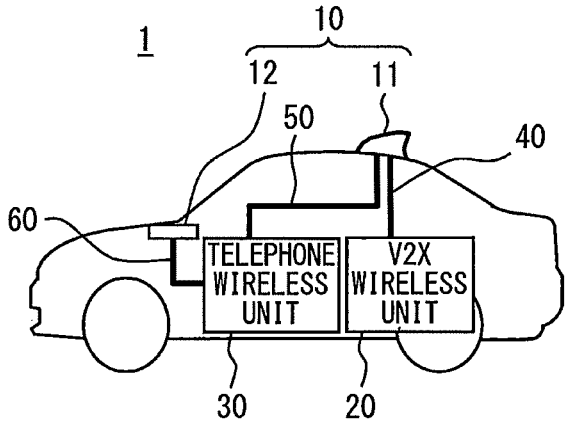
FIG. 1 is a diagram illustrating a communication apparatus including an antenna system according to a first embodiment.

Embodiments of the present disclosure will be described below with reference to the accompanying drawings. As illustrated in FIG. 1, a communication apparatus 1 includes an antenna system 10 according to a first embodiment, a V2X wireless unit 20, and a telephone wireless unit 30.

The antenna system 10 includes a first antenna unit 11 and a second antenna unit 12. The first antenna unit 11 is disposed at a rear end portion of an upper surface of a vehicle roof part, which is a part of an upper surface of a vehicle body. The second antenna unit 12 is disposed in the vicinity of a front end of a vehicle interior.

The V2X wireless unit 20 is a known wireless unit for a communication system that performs at least one of vehicle-to-vehicle communication and roadside-to-vehicle communication (hereafter, referred to as a vehicle-to-vehicle roadside-to-vehicle communication system). The V2X wireless unit 20 includes a transmitting portion, a receiving portion, and a communication control portion. The transmitting portion performs a modulation for transmission. The receiving portion performs a demodulation of a received signal. The communication control portion controls the transmitting portion and the receiving portion. The vehicle-to-vehicle roadside-to-vehicle communication system corresponds to a first communication system. The V2X wireless unit 20 and the first antenna unit 11 are connected with each other via a coaxial cable 40.

The telephone wireless unit 30 is a wireless unit for a communication system using a mobile phone network (hereafter, referred to as a telephone communication system). The telephone communication system corresponds to a second communication system.

The telephone wireless unit 30 includes a transmitting portion, a receiving portion, and a communication control portion, which are known, for performing communication using the mobile phone network. The telephone wireless unit 30 performs communication by a multi input multi output (MIMO) method. The MIMO needs a plurality of antennas for transmission and reception with small correlation between each other. In the present embodiment, a plurality of antennas having a polarization diversity structure as a structure for reducing correlation is used. Because a base station of the telephone communication system uses antennas of horizontal polarization and vertical polarization, the telephone communication system according to the present embodiment uses a polarization diversity communication system.

The telephone wireless unit 30 is connected with the first antenna unit 11 via a coaxial cable 50 and is connected with the second antenna unit 12 via a coaxial cable 60.

[Configuration of First Antenna Unit]

Figure 2:
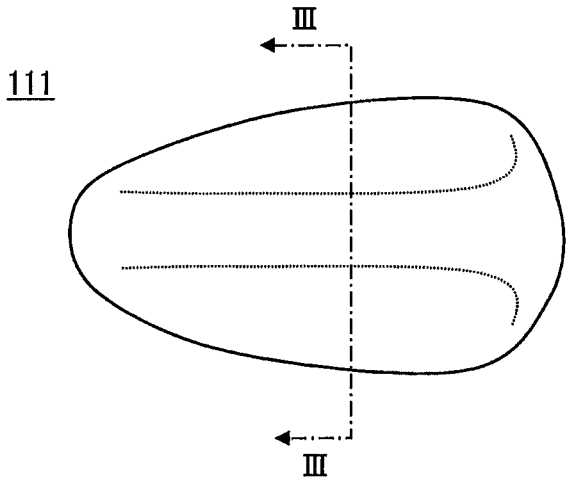
FIG. 2 is top view of a case of a first antenna unit.

An case 111 illustrated in FIG. 2 has a shape similar to a fin of a shark or a dolphin and is called a shark fin antenna or a dolphin antenna. Specifically, a top view of the case 111 has a streamline shape, and a length of the case 111 in a width direction decreases from a vehicle rear side to a vehicle front side.

A length of the case 111 in a longitudinal (i.e., front-to-rear) direction of the vehicle is longer than the length of the case 111 in a width (i.e., right-to-left) direction of the vehicle. Specifically, as illustrated in FIG. 3, the length of the case 111 in the width direction of the vehicle decreases from a bottom side to a top side.

The case 111 is disposes in such a manner that a longitudinal direction of the case 111 corresponds to the longitudinal direction of the vehicle. Because the case 111 has the streamline shape, a length of an internal space of the case 111 in the longitudinal direction of the vehicle is longer than a length of the internal space of the case 111 in the width direction of the vehicle. The case 111 is made of resin.

Figure 3:
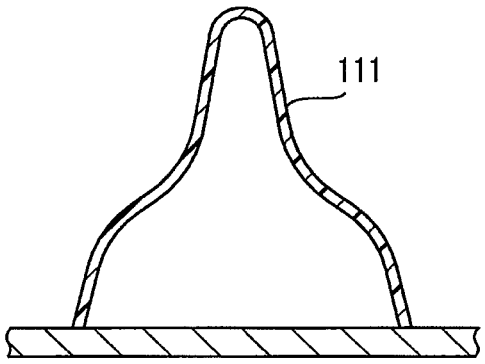
FIG. 3 is a cross-sectional view of the case taken along line III-III in FIG. 2.

Because FIG. 3 is a diagram for explaining the shape of the case 111, components disposed inside the case 111 are omitted in FIG. 3.

Figure 4:
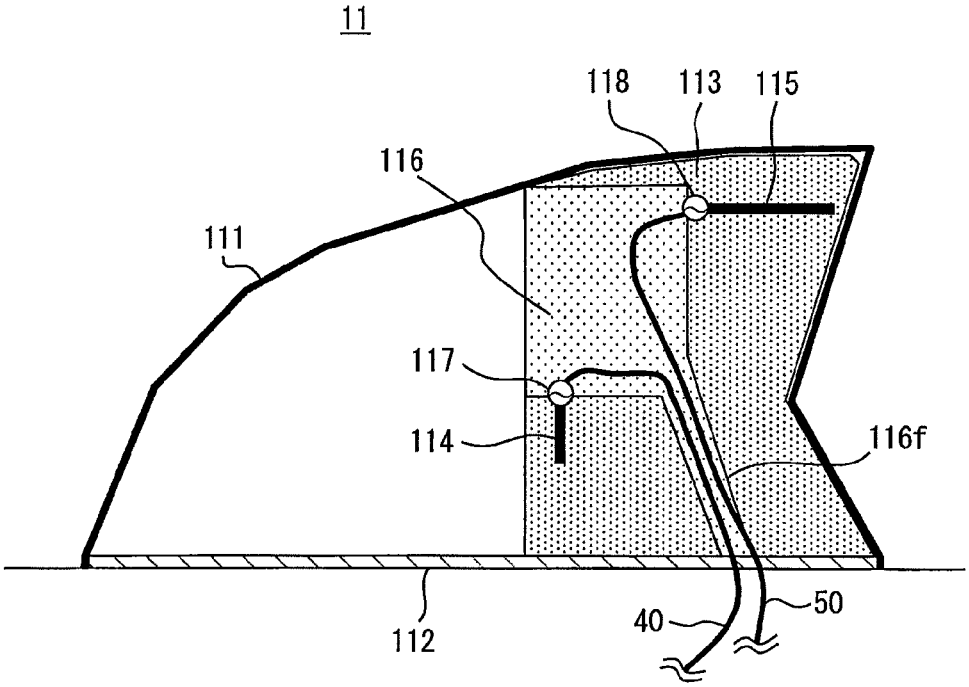
FIG. 4 is a diagram illustrating the first antenna unit according to the first embodiment.

As illustrated FIG. 4, the first antenna unit 11 is fully covered by the case 111. A height of the case 111 increases from the vehicle front side to the vehicle rear side. In the internal space of the case 111, a ground plate 112, a printed circuit board 113, a V2X antenna 114, and a telephone antenna 115 are housed. The V2X antenna 114 corresponds to an antenna configured for the first communication system. The telephone antenna 115 corresponds to an inside orthogonal antenna configured for the polarization diversity communication system. FIG. 4 is a diagram for explaining a positional relationship between the V2X antenna 114 and the telephone antenna 115, and a part of other configuration is omitted.

The printed circuit board 113 is disposed at almost the center of the case 111 in the width direction such that a surface on which a ground pattern 116 is formed is disposed along a longitudinal direction of the vehicle roof part. The longitudinal direction of the vehicle roof part is parallel to the longitudinal direction of the vehicle. The ground pattern 166 made of a copper film is formed on the printed circuit board 113. A connection portion **116*f* forming a part of the ground pattern 116 is connected with the ground plate 112**.

The V2X antenna 114 is an antenna element of a monopole antenna and is connected with a feeding point 117 disposed at a lower end of the ground pattern 116. In the present specification, an antenna element is described simply as an antenna.

The ground pattern 116 and the V2X antenna 114 form the monopole antenna. The feeding point 117 is also connected with an end of the coaxial cable 40. Accordingly, the V2X antenna 114 is connected with the V2X wireless unit 20.

The V2X antenna 114 is disposed on a surface of the printed circuit board 113. The V2X antenna 114 extends downward in a vertical direction from the feeding point 117 in a state where the vehicle equipped with the first antenna unit 11 is located on a horizontal ground and the vehicle roof part is horizontal to the ground. In other words, an axial direction of the V2X antenna 114 is perpendicular to the longitudinal direction of the vehicle roof part and is further perpendicular to width direction of the vehicle roof part (i.e., the right-to-left direction of the vehicle). In the present specification, "vertical" means not only strictly vertical but also almost vertical. In addition, "perpendicular" used hereafter without specifying a reference means perpendicular to the ground, that is, vertical. In addition, in the present specification, "horizontal", "perpendicular", "orthogonal" respectively mean not only strictly horizontal, strictly perpendicular, strictly orthogonal but also almost horizontal, almost perpendicular, almost orthogonal. Furthermore, in the present specification, when "perpendicular", "vertical", "horizontal" are used without specifying inclination of the vehicle, it is assumed that the vehicle is located on a horizontal ground.

Because the V2X antenna 114 extends downward in the vertical direction from the feeding point 117, radio waves transmitted from and received by the V2X antenna 114 are mainly vertically polarized wave. The vehicle-to-vehicle communication and the roadside-to-vehicle communication use vertically polarized waves. Thus, the communication apparatus 1 can favorably perform the vehicle-to-vehicle communication and the roadside-to-vehicle communication by using the V2X antenna 114. The vehicle-to-vehicle communication and the roadside-to-vehicle communication in the present embodiment are performed in a 5.9 GHz band. An element length of the V2X antenna 114 is set based on this frequency.

The telephone antenna 115 is also an antenna element of a monopole antenna and is connected with a feeding point 118 disposed at a vehicle rear end and an upper portion of the ground pattern 116. The ground pattern 116 and the telephone antenna 115 form a monopole antenna. Because the ground pattern 116 is disposed in an upper internal space of the case 111 and the feeding point 118 is disposed at the upper portion of the ground pattern 116, the telephone antenna 115 is disposed in the upper internal space of the case 111.

The feeding point 118 is also connected with an end of the coaxial cable 50. Accordingly, the telephone antenna 115 is connected with the telephone wireless unit 30.

The telephone antenna 115 is disposed on the surface of the printed circuit board 113 and extends from the feeding point 118 in the longitudinal direction of the vehicle roof part. Because the vehicle roof part is usually almost horizontal to the ground, in a state where the vehicle is located on the horizontal ground, radio waves transmitted from and received by the telephone antenna 115 are mainly horizontally polarized wave. In addition, the telephone antenna 115 is disposed orthogonal to the V2X antenna 114.

In the present embodiment, the base station of the telephone communication system uses a horizontally polarized wave as one polarized wave. Thus, the telephone antenna 115 is disposed so as to be adapted to communication with the base station. The telephone communication system in the present embodiment uses a lower frequency than the vehicle-to-vehicle communication and the roadside-to-vehicle communication. For example, the telephone communication system uses one of 800 MHz band, 900 MHz band, 1800 MHz band, and 2.1 GHz band. An element length of the telephone antenna 115 is set based on this frequency. Thus, the element length of the telephone antenna 115 is longer than the element length of the V2X antenna 114.

[Configuration of Second Antenna Unit]

Figure 5:
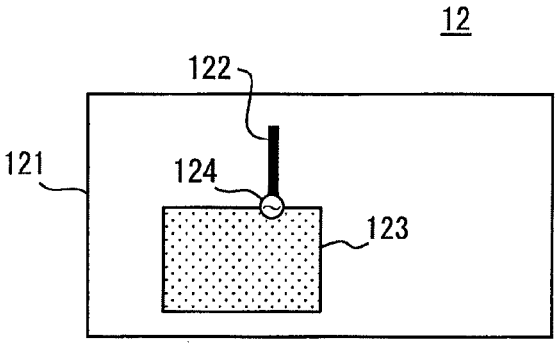
FIG. 5 is a diagram illustrating a second antenna unit according to the first embodiment.

FIG. 5 is a diagram illustrating the second antenna unit 12. The second antenna unit 12 includes a case 121 and a telephone antenna 122 disposed in the case 121. The telephone antenna 122 is also an antenna element of a monopole antenna. The telephone antenna 122 is connected to a feeding point 124 disposed at an upper end of a ground pattern 123 formed in a substrate, which is not illustrated. The ground pattern 123 and the telephone antenna 122 form the monopole antenna. Although it is not illustrated, the feeding point 124 is connected with the coaxial cable 60. Accordingly, the telephone antenna 122 is connected to the telephone wireless unit 30.

The telephone antenna 122 corresponds to an outside orthogonal antenna. The telephone antenna 122 is disposed orthogonal to the telephone antenna 115. In other words, the telephone antenna 122 extends upward from the feeding point 124. In a state where the vehicle is located on a horizontal ground, an axial direction of the telephone antenna 122 is the vertical direction. Thus, radio waves transmitted from and received by the telephone antenna 122 are mainly vertically polarized wave. Because the telephone antenna 115 in the first antenna unit 11 is the antenna for the horizontally polarized wave, a communication performance of the polarization diversity structure can be secured. The telephone antennas 115, 122 correspond to polarization diversity communication system antennas.

Effects of the First Embodiment

In the present embodiment, the V2X antenna 114 and the telephone antenna 115 disposed in the same case 111 are orthogonal to each other. In other words, main radiation polarization planes of the monopole antennas respectively including the V2X antenna 114 and the telephone antenna 115 are orthogonal to each other. Thus, even when the case 111 is small and the V2X antenna 114 and the telephone antenna 115 are disposed adjacent to each other, isolation between the V2X antenna 114 and the telephone antenna 115 can be enhanced. Thus, isolation between the vehicle-to-vehicle roadside-to-vehicle communication system and the telephone communication system can be enhanced, and radio wave interference between the communication systems can be suppressed.

The telephone antenna 122 is disposed outside the case 111. Specifically, the second antenna unit 12 including the telephone antenna 122 is disposed in the vicinity of the front end of the vehicle interior while the first antenna unit 11 including the V2X antenna 114 and the telephone antenna 115 is disposed at the rear end of the vehicle roof part. In other words, the telephone antenna 122 is disposed at a position sufficiently separated from the V2X antenna 114 and the telephone antenna 115 in view of wavelengths of radio waves to be used. Thus, isolation of the telephone antenna 122 can be enhanced.

In addition, the telephone antenna 122 is disposed orthogonal to the telephone antenna 115. In other words, a main radiation polarization plane of the telephone antenna 122 is orthogonal to the main radiation polarization plane of the telephone antenna 115. Thus, the communication performance of the telephone communication system, which is the polarization diversity communication system, can be secured.

Furthermore, the telephone antenna 115 is disposed on the surface of the printed circuit board 113 similarly to the V2X antenna 114 and is disposed in the longitudinal direction of the vehicle using a fact that the length of the internal space of the case 111 in longitudinal direction of the vehicle roof part is longer than the length of the internal space of the case 111 in the width direction of the vehicle roof part. Accordingly, the telephone antenna 115 and the V2X antenna 114 are disposed orthogonal to each other. Thus, the length of the case 111 in the width direction of the vehicle roof part can be reduced, and air resistance can be reduced.

Second Embodiment

Next, a first antenna unit 11 according to a second embodiment of the present disclosure will be described with reference to FIG. 6. In the following description, elements with reference numerals which are already used have the same structure as elements with the same reference numerals in the above-described embodiments. When only a part of structure is described, the description in the above-described embodiment can be applied to the other part of the structure.

Figure 6:
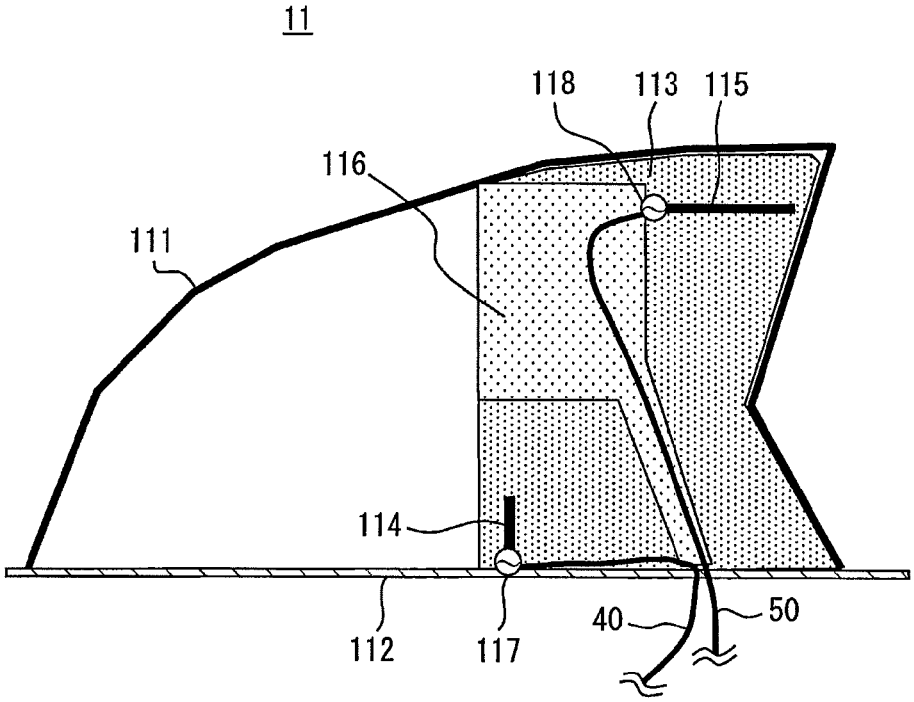
FIG. 6 is a diagram illustrating a first antenna unit according to a second embodiment.

As illustrated in FIG. 6, the first antenna unit 11 according to the present embodiment is different from the first antenna unit 11 according to the first embodiment in an arrangement of the V2X antenna 114. In the present embodiment, the V2X antenna 114 is disposed on the ground plate 112. Thus, the feeding point 117 is also disposed on the ground plate 112. The V2X antenna 114 extends upward in the vertical direction from the feeding point 117. When the vehicle is located on a horizontal ground and the vehicle roof part is horizontal to the ground, the axial direction of the V2X antenna is the vertical direction.

Also when the V2X antenna 114 is disposed as described above, radio waves transmitted from and received by the V2X antenna 114 are mainly vertically polarized waves. Thus, even if the V2X antenna 114 and the telephone antenna 115 are disposed adjacent to each other, isolation between the V2X antenna 114 and the telephone antenna 115 can be enhanced. Thus, isolation between the vehicle-to-vehicle roadside-to-vehicle communication system and the telephone communication system can be enhanced, and radio wave interference between the communication systems can be suppressed. In addition, the communication performance of the telephone communication system, which is the polarization diversity communication system, can be secured.

Third Embodiment

A first antenna unit 11 according to a third embodiment of the present description will be described with reference to FIG. 7 and FIG. 8. The first antenna unit 11 according to the present embodiment uses a telephone antenna 115A instead of the telephone antenna 115 in the first embodiment. The telephone antenna 115A is a loop-shaped antenna. In the present embodiment, the telephone antenna 115A corresponds to an inside orthogonal antenna.

Figure 7:
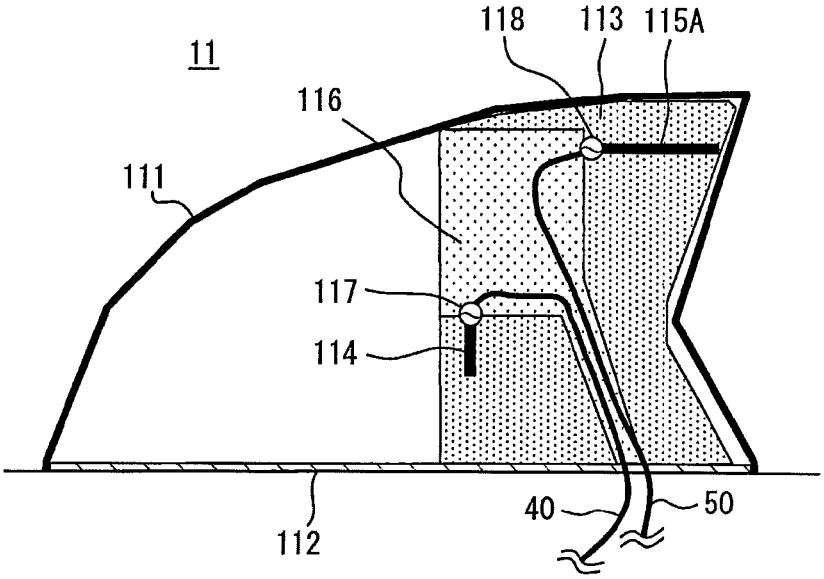
FIG. 7 is a diagram illustrating a first antenna unit according to a third embodiment.
Figure 8:
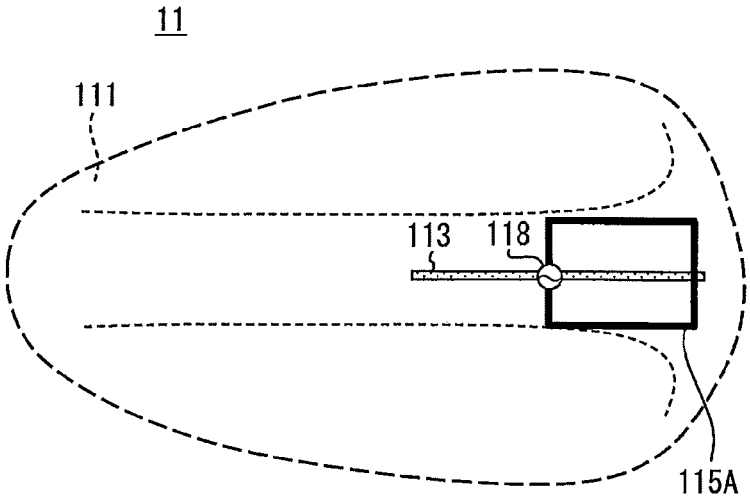
FIG. 8 is a diagram illustrating the first antenna unit according to the third embodiment viewed from above.

The telephone antenna 115A illustrated in FIG. 7 and FIG. 8 is disposed at the same position as the telephone antenna 115 in the first embodiment. In a state where the vehicle is located on a horizontal ground, the telephone antenna 115A extends from the feeding point 118 to the rear side of the vehicle roof part in a horizontal plane. The telephone antenna 115A extending in the above-described direction is parallel to the longitudinal direction of the vehicle roof part and is parallel to the width direction of the vehicle roof part. Because the vehicle roof part is usually almost horizontal to the ground, in a state where the vehicle is located on the horizontal ground, radio waves transmitted from and received by the telephone antenna 115A are mainly horizontally polarized waves.

Also in the present embodiment, in a manner similar to the first embodiment and the second embodiment, the telephone antenna 115A is disposed in the same case 111 with the V2X antenna 114 in a state where the telephone antenna 115A is disposed orthogonal to the V2X antenna 114. Thus, isolation between the V2X antenna and the telephone antenna 115A can be enhanced. Thus, isolation between the vehicle-to-vehicle roadside-to-vehicle communication system and the telephone communication system can be enhanced, and radio wave interference between the communication systems can be suppressed. Furthermore, the telephone antenna 115A and the telephone antenna 122 are disposed orthogonal to each other. Thus, the communication performance of the telephone communication system, which is the polarization diversity communication system, can be secured.

Fourth Embodiment

Figure 9:
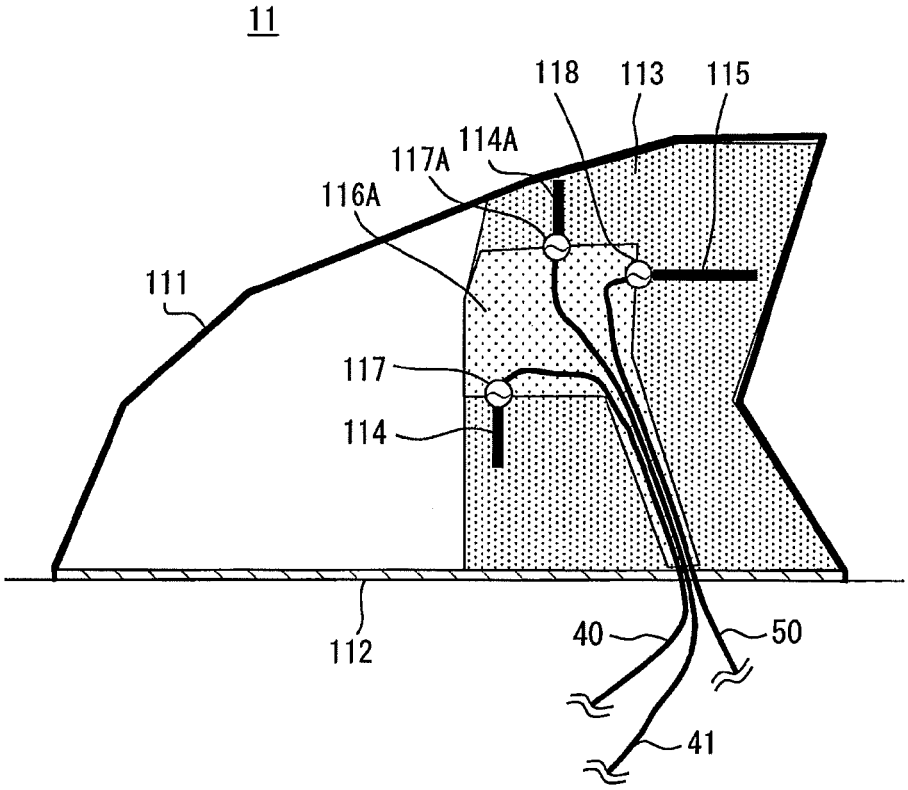
FIG. 9 is a diagram illustrating a first antenna unit according to a fourth embodiment.

A first antenna unit 11 according to a fourth embodiment will be described with reference to FIG. 9. The first antenna unit 11 according to the present embodiment includes a V2X antenna 114A in addition to the V2X antenna 114 according to the first embodiment.

An upper end of a ground pattern 116A according to the present embodiment is lower than the upper end of the ground pattern 116 according to the first embodiment. On the upper end of the ground pattern 116A, a feeding point 117A is disposed. The V2X antenna 114A is connected with the feeding point 117A and extends upward in the vertical direction from the feeding point 117A. When the vehicle is located on a horizontal ground and the vehicle roof part is located in parallel with the ground, the axial direction of the V2X antenna 114A is the vertical direction. The feeding point 117A is also connected with a coaxial cable 41. The coaxial cable 41 is also connected with the V2X wireless unit 20 in a manner similar to the coaxial cable 40.

In the present embodiment, the first antenna unit 11 includes the two V2X antennas 114, 114A which mainly transmit and receive vertically polarized wave and the telephone antenna 115. The telephone antenna 115 is disposed orthogonal to both of the two V2X antennas 114, 114A.

In the present embodiment, the telephone antenna 115 housed in the same case 111 with the V2X antennas 114, 114A is disposed orthogonal to the V2X antennas 114, 114A. Thus, isolation between the V2X antennas 114, 114A and the telephone antenna 115 can be enhanced. Therefore, isolation between the vehicle-to-vehicle roadside-to-vehicle communication system and the telephone communication system can be enhanced, and radio wave interference between the communication systems can be suppressed. In addition, the telephone antennas 115, 122 are disposed orthogonal to each other. Thus, the communication performance of the telephone communication system, which is the polarization diversity communication system, can be secured.

Fifth Embodiment

A first antenna unit 11 according to a fifth embodiment of the present disclosure will be described with reference to FIG. 10 and FIG. 11. The first antenna unit 11 according to the present embodiment includes a telephone antenna 115B disposed at a position different from the telephone antenna 115 according to the fourth embodiment. The telephone antenna 115B is disposed instead of the telephone antenna 115 according to the fourth embodiment. In the present embodiment, the telephone antenna 115B corresponds to an inside orthogonal antenna.

Figure 10:
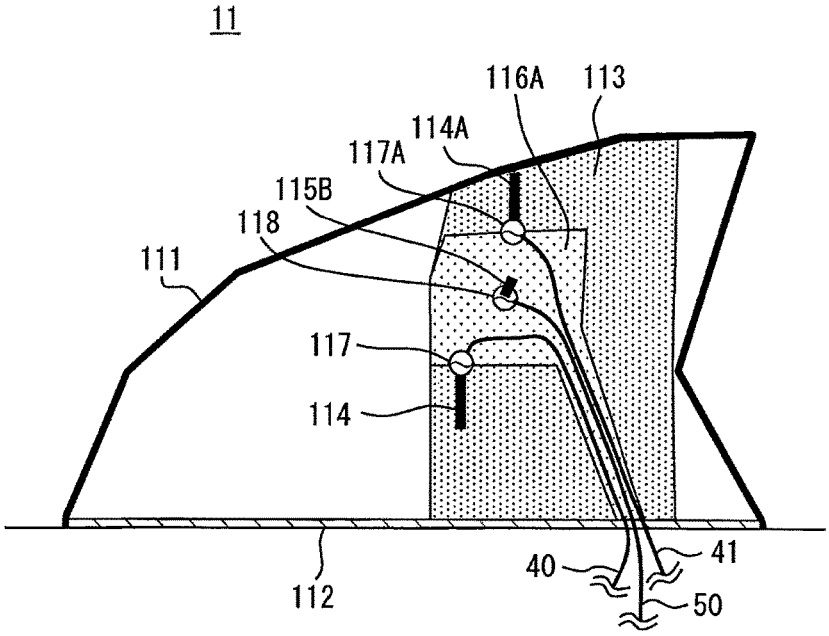
FIG. 10 is a diagram illustrating a first antenna unit according to a fifth embodiment.
Figure 11:
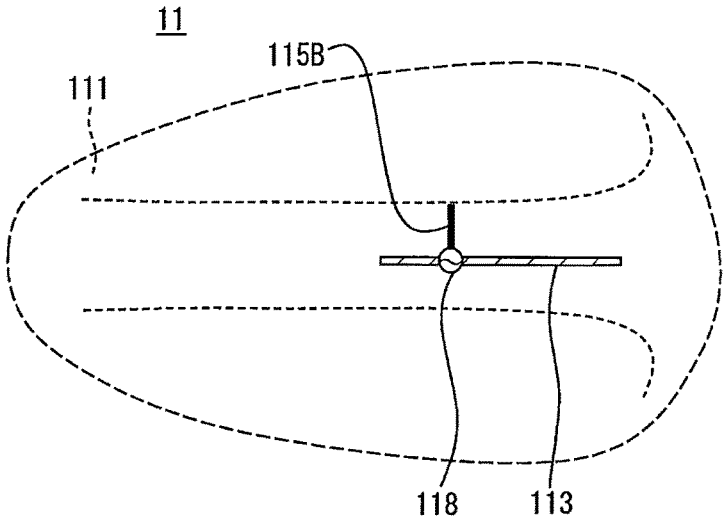
FIG. 11 is a diagram illustrating the first antenna unit according to the fifth embodiment viewed from above.

In the present embodiment, as illustrated in FIG. 10, the feeding point 118 connected with the coaxial cable 60 is disposed at almost the center of the ground pattern 116A. The telephone antenna 115B is an antenna element of a monopole antenna and is connected with the feeding point 118. The ground pattern 116A and the telephone antenna 115B form the monopole antenna.

In a state where the vehicle is located on a horizontal ground, the telephone antenna 115B extends in the horizontal direction from the feeding point 118. In addition, as illustrated in FIG. 11, the telephone antenna 115B protrudes perpendicularly from the surface of the printed circuit board 113. Needless to say, at a position where the telephone antenna 115B is disposed, the length of the case 111 in the width direction is enough to dispose the telephone antenna 115.

When the using frequency of the telephone communication system is 800 MHz, λ/4 is about 9 cm, and the length of the case 111 in the width direction becomes long. However, higher frequencies, such as 3 GHz, are examined as the frequency of the telephone communication system. If the frequency of the telephone communication system is 3 GHz, λ/4 is about 2.5 cm, and the length of the case 111 in the width direction becomes not so long.

The telephone antenna 115B according to the present embodiment is disposed in the width direction of the vehicle roof part while the telephone antenna 115 according to the fourth embodiment is disposed in the longitudinal direction of the vehicle roof part. However, the telephone antenna 115B is disposed orthogonal to the V2X antennas 114, 114A, similarly to the fourth embodiment. Because isolation between the V2X antennas 114, 114A and the telephone antenna 115B can be enhanced, isolation between the vehicle-to-vehicle roadside-to-vehicle communication system and the telephone communication system can be enhanced, and radio wave interference between the communication systems can be suppressed. In addition, the telephone antennas 115B, 122 are disposed orthogonal to each other. Thus, the communication performance of the telephone communication system, which is the polarization diversity communication system, can be secured.

Sixth Embodiment

Figure 12:
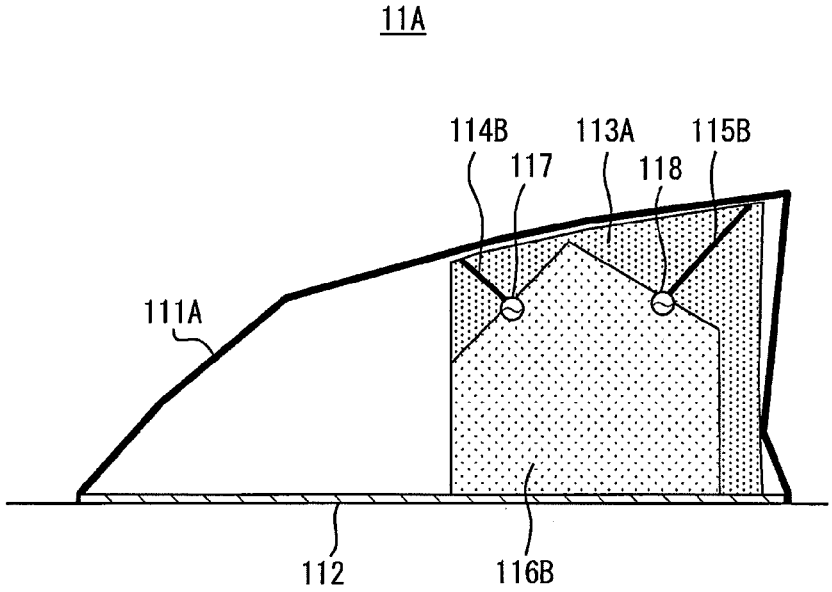
FIG. 12 is a diagram illustrating a first antenna unit according to a sixth embodiment.

A first antenna unit 11A according to a sixth embodiment of the present disclosure will be described with reference to FIG. 12. In the first antenna unit 11A, a V2X antenna 114B and a telephone antenna 115B are inclined 45 degrees with respect to the ground plate 112.

Specifically, a ground pattern 116B having a pentagonal shape is formed on a printed circuit board 113A in the first antenna unit 11A, and the feeding points 117, 118 are respectively disposed on the two inclined sides of the ground pattern 116B. Although it is not illustrated in FIG. 12, the feeding points 117, 118 are connected with the coaxial cables 40, 50.

The feeding point 117 is connected with the V2X antenna 114B and the feeding point 118 is connected with the telephone antenna 115B. Each of the V2X antenna 114B and the telephone antenna 115B is an antenna element of a monopole antenna, and is disposed along the surface of the printed circuit board 113A. The telephone antenna 115B corresponds to an inside orthogonal antenna.

The V2X antenna 114B is inclined 45 degrees with respect to the ground plate 112. On the other hand, the telephone antenna 115B is inclined 45 degrees with respect to the ground plane 112 in an opposite direction from the V2X antenna 114B.

In other words, also in the present embodiment, the V2X antenna 114B and the telephone antenna 115B are disposed orthogonal to each other. Thus, isolation of the V2X antenna 114B and the telephone antenna 115B can be enhanced. Therefore, isolation between the vehicle-to-vehicle and roadside-to-vehicle communication system and the telephone communication system can be enhanced, and radio wave interference between the communication systems can be suppressed. Although it is not illustrated, the telephone antenna 122 included in the second antenna unit 12 is disposed orthogonal to the telephone antenna 115B. Accordingly, the communication performance of the telephone communication system can be secured.

In addition, the V2X antenna 114B and the telephone antenna 115B are disposed along the surface of the printed circuit board 113A so as to be orthogonal to each other. Thus, the length of the case 111A in the width direction can be reduced while disposing the V2X antenna 114B and the telephone antenna 115B orthogonal to each other, and thereby the air resistance can be reduced.

Seventh Embodiment

A first antenna unit 11B according to a seventh embodiment of the present disclosure will be described with reference to FIG. 13. The first antenna unit 11B includes the V2X antenna 114 same as the V2X antenna 114 in the above-described embodiments. Also in the present embodiment, the V2X antenna 114 extends upward in the vertical direction from the feeding point 117. The feeding point 117 is disposed on a ground pattern 116C.

The first antenna unit 11B includes three telephone antennas 115, 115C, 115D. Each of the telephone antennas 115, 115C, 115D is an antenna element of a monopole antenna and corresponds to an inside antenna. The telephone antennas 115, 115C, 115D are respectively connected with feeding points 118, 118A, 118B disposed on a ground pattern 116D. In the present embodiment, the two ground patterns 116C, 116D are formed. However, the ground patterns 116C, 116D may be integrated.

The three telephone antennas 115, 115C, 115D are disposed along the surface of the printed circuit board 113 at different angles.

In a state where the vehicle is located on a horizontal ground, the telephone antenna 115 extends toward the rear side of the vehicle roof part in a horizontal plane. The feeding point 118 connected with the telephone antenna 115 is disposed at a rear end of the ground pattern 116D. In the three telephone antennas 115, 115C, 115D, the telephone antenna 115 is disposed at a position farthest from the V2X antenna 114.

The feeding point 1188 connected with the telephone antenna 115D is disposed on an upper side of the ground pattern 116D. The telephone antenna 115D extends upward in the vertical direction in a manner similar to the V2X antenna 114.

The telephone antenna 115C is disposed between the two telephone antennas 115, 115D at an angle that is middle of angles of the two telephone antennas 115, 115D. In other words, one end of the telephone antenna 115C is connected with the feeding point 118A, and the telephone antenna 115C is disposed at 45 degrees with respect to a plane including the telephone antenna 115 and parallel to the width direction of the vehicle roof part so that the other end of the telephone antenna 115C is separated from the V2X antenna 114 compared with the one end of the telephone antenna 115C.

The telephone antennas 115, 115C, 115D have different using frequencies. Specifically, the using frequency of the telephone antenna 115 is closest to the using frequency of the V2X antenna 114, and is 2.1 GHz, for example. The using frequency of the telephone antenna 115D, which is disposed at a position closest to the V2X antenna 114, is farthest from the using frequency of the V2X antenna 114, and is 800 MHz, for example. The using frequency of the telephone antenna 115C disposed between the two telephone antennas 115, 115D is a frequency between the using frequencies of the two telephone antennas 115, 115D, and is 1.8 GHz; for example.

Figure 14:
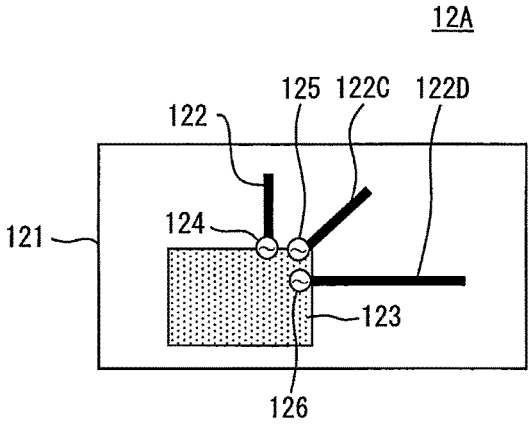
FIG. 14 is a diagram illustrating a second antenna unit according to the seventh embodiment.

Next, a second antenna unit 12A according to the present embodiment will be described with reference to FIG. 14. The second antenna unit 12A is disposed at the same position as the second antenna unit 12 according to the first embodiment.

Figure 13:
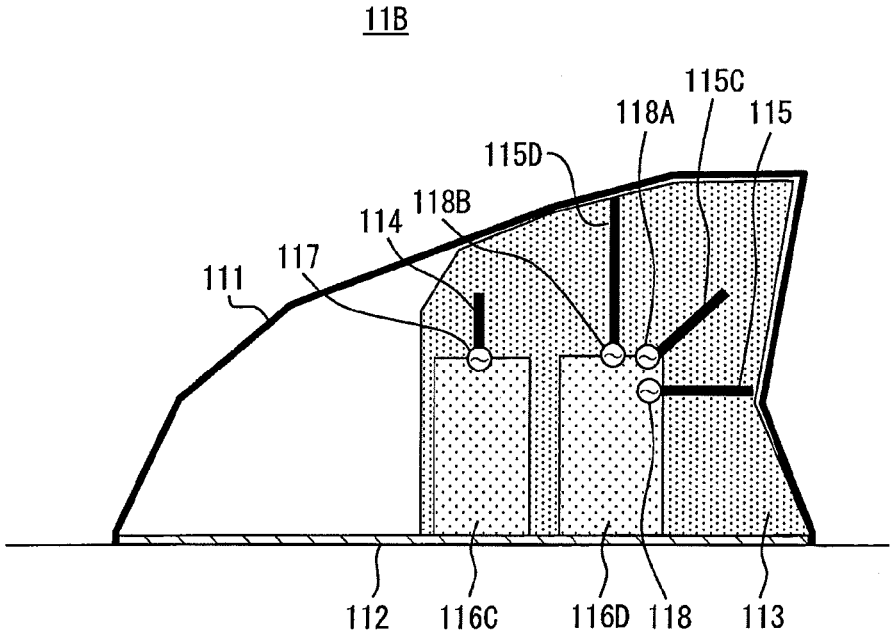
FIG. 13 is a diagram illustrating a first antenna unit according to a seventh embodiment.

The second antenna unit 12A includes three telephone antennas 112, 122C, 122D respectively paired with the three telephone antennas 115, 115C, 115D in the first antenna unit 11B illustrated in FIG. 13. Each of the three telephone antennas 122, 122C, 122D is an antenna element of a monopole antenna and corresponds to an outside antenna.

The telephone antenna 122 of the present embodiment is the same as the telephone antenna 122 according to the first embodiment and extends upward in the vertical direction from the feeding point 124 disposed on the upper end of the ground pattern 123. The telephone antenna 122 extends from a feeding point 126 disposed on a rear end of the ground pattern 123 toward a rear side of the vehicle in the front-to-rear direction of the vehicle roof part.

The telephone antenna 122C is connected with a feeding point 125 disposed between the feeding points 124, 126 connected with the two telephone antennas 122, 122D. The telephone antenna 122C is disposed at an angle that is middle of angles of the telephone antennas 122, 122D. In other words, the telephone antenna 122C is disposed at 45 degrees with respect to a plane including the telephone antenna 122 and parallel to the width direction of the vehicle roof part.

In the present embodiment, the V2X antenna 114 is disposed vertically and the three telephone antennas 115, 115C, 115D are disposed in the same case 111 with the V2X antenna 114. The three telephone antennas 115, 115C, 115D are disposed in such a manner that one of the telephone antennas 115, 115C, 115D whose using frequency is closer to the using frequency of the V2X antenna 114 has a main radiation polarization plane closer to orthogonal to the main radiation polarization plane of the V2X antenna 114. In the three telephone antennas 115, 115C, 115D, the telephone antenna 115 whose using frequency is closest to the using frequency of the V2X antenna is most likely to interfere with the V2X antenna 114 in view of frequency. However, in the present embodiment, the telephone antenna 115 is disposed orthogonal to the V2X antenna 114. In other words, the main radiation polarization planes of the monopole antennas including the V2X antenna 114 and the telephone antenna 115, respectively, are orthogonal to each other. Thus, radio wave interference between the telephone communication system using the telephone antenna 115 and the vehicle-to-vehicle roadside-to-vehicle communication system using the V2X antenna 114 can be effectively suppressed. Furthermore, the telephone antenna 115 is disposed farthest from the V2X antenna 114. Also from this point, the radio wave interference between the both communication systems can be suppressed.

The telephone antenna 115D transmits and receives vertically polarized wave similarly to the V2X antenna 114. However, the using frequency of the telephone antenna 115 is farthest from the using frequency of the V2X antenna 114 in the three telephone antennas 115, 115C, 115D. Thus, interference between the telephone antenna 115D and the V2X antenna 114 are relatively low.

Accordingly, in the present embodiment, isolation between each of the telephone antennas 115, 115C, 115D using three different frequencies and the V2X antenna 114 can be secured while the telephone antennas 115, 115C, 115D are disposed in the same case 111 with the V2X antenna 114. As a result, also in the present embodiment, the radio wave interference between the telephone communication system and the vehicle-to-vehicle roadside-to-vehicle communication system can be secured.

In addition, the second antenna unit 12A disposed on the front end of the vehicle interior includes the three telephone antennas 122, 122C, 112D respectively paired with the three telephone antennas 115, 115C, 115D. Because the telephone antenna 122 paired with the telephone antenna 115, which is disposed horizontally, is disposed vertically, the communication performance of the telephone communication system, which is a polarization diversity communication system, can be secured by the combination of the telephone antennas 115, 122. In addition, because the telephone antenna 122D paired with the telephone antenna 115, which is disposed vertically, is disposed horizontally, the communication performance of the telephone communication system can be secured also by the combination of the telephone antennas 115D, 122D.

Both of the telephone antennas 115C, 122C are disposed at 45 degrees. Thus, both of the telephone antennas 115C, 122C can transmit and receive horizontally polarized wave and vertically polarized wave to some extent. Thus, the communication performance of the telephone communication system can be secured also by the combination of the telephone antennas 115C, 122C.

Accordingly, in the present embodiment, the communication performance of the telephone communication system can be secured while the three telephone antennas 115, 115C, 115D are disposed in the same case 111 with the V2X antenna 114.

Other Embodiments

Although the present invention has been fully described in connection with the preferred embodiments thereof with reference to the accompanying drawings, it is to be noted that various changes and modifications will become apparent to those skilled in the art.

In the seventh embodiment, three pairs of telephone antennas 115, 115C, 115D, 122, 122C, 122D for forming the polarization diversity communication system are provided. The number of pairs of antennas for forming the polarization diversity communication system may also be two, or more than three.

In the above-described embodiments, the telephone communication system is described as an example of the polarization diversity communication system. However, the present disclosure may be applied to a polarization diversity communication system other than telephone.

In the above-described embodiments, each of the telephone antennas 122, 122C, 122D included in the second antenna units 12, 12A is an antenna element of a monopole antenna. Instead of the monopole antenna, a loop-shaped antenna may also be used.

What is claimed is:

1. An antenna system comprising:

a case configured to be disposed on an upper surface of a vehicle body;

a substrate disposed in the case and disposed along a longitudinal direction and a vertical direction of the vehicle body;

an antenna configured for a first communication system and disposed on the substrate;

an inside orthogonal antenna configured for a polarization diversity communication system used for a second communication system and disposed on the substrate such that a main radiation polarization plane of the inside orthogonal antenna is orthogonal to a main radiation polarization plane of the antenna for the first communication system; and an outside orthogonal antenna configured for the polarization diversity communication system and disposed outside the case such that a main radiation polarization plane of the outside orthogonal antenna is orthogonal to the main radiation polarization plane of the inside orthogonal antenna; wherein the outside orthogonal antenna is disposed apart from the case in the longitudinal direction of the vehicle body and extends only in a direction perpendicular to the inside orthogonal antenna;

the antenna for the first communication system extends only in one direction; and the inside orthogonal antenna extends only in another direction, which is orthogonal to the one direction.

2. The antenna system according to claim 1, wherein a length of the case in the longitudinal direction of the vehicle body is longer than a length of the case in a width direction of the vehicle body, each of the antenna for the first communication system and the inside orthogonal antenna is an element of a monopole antenna, and the element of the antenna for the first communication system and the element of the inside orthogonal antenna are disposed in directions along the substrate.

3. The antenna system according to claim 2, wherein the element of the antenna for the first communication system extends in the vertical direction, and the element of the inside orthogonal antenna extends in the longitudinal direction of the vehicle body.

4. The antenna system according to claim 2, further comprising one or more inside antennas configured for the polarization diversity communication system and disposed inside the case; and one or more outside antennas configured for the polarization diversity communication system, disposed outside the case, and respectively paired with the inside antennas, wherein the inside orthogonal antenna is one of the inside antennas, and the outside orthogonal antenna is one of the outside antennas, the inside antennas are disposed in such a manner that one of the inside antennas whose using frequency is closer to a using frequency of the antenna for the first communication system has a main radiation polarization plane closer to orthogonal to the main radiation polarization plane of the antenna for the first communication system, and one of the inside antennas whose using frequency is closest to the using frequency of the antenna for the first communication system is the inside orthogonal antenna having the main radiation polarization plane orthogonal to the main radiation polarization plane of the antenna for the first communication system.

5. The antenna system according to claim 1, wherein the antenna for the first communication system is an element of a monopole antenna and the element extends in the vertical direction, and the inside orthogonal antenna is a loop-shaped antenna disposed in a horizontal direction.

6. The antenna system according to claim 1, wherein each of the antenna for the first communication system and the inside orthogonal antenna is an element of a monopole antenna, the element of the antenna for the first communication system extends in the vertical direction, and the element of the inside orthogonal antenna protrudes perpendicularly from a surface of the substrate.

7. An antenna unit used for the antenna system according to claim 1, comprising the case, the antenna for the first communication system, and the inside orthogonal antenna.

8. The antenna system according to claim 1, wherein the case is disposed at a rear end of a roof of the vehicle body; and the outside orthogonal antenna is disposed in a vicinity of a front end of a vehicle interior.

9. The antenna system according to claim 1, wherein an extent of the outside orthogonal antenna, which is measured in the longitudinal direction of the vehicle body, does not overlap with an extent of the case, which is measured in the longitudinal direction of the vehicle body.

10. The antenna system according to claim 1, further comprising a ground pattern that is electrically grounded and is formed on the substrate to extend in both of the longitudinal direction and the vertical direction of the vehicle body, wherein a feeding point for the inside orthogonal antenna is connected to the inside orthogonal antenna and the ground pattern.

11. An antenna unit comprising:

a case configured to be disposed on an upper surface of a vehicle body;

a substrate disposed in the case and disposed along a longitudinal direction and a vertical direction of the vehicle body;

an antenna configured for a first communication system and disposed on the substrate;

an inside orthogonal antenna configured for a polarization diversity communication system used for a second communication system and disposed on the substrate such that a main radiation polarization plane of the inside orthogonal antenna is orthogonal to a main radiation polarization plane of the antenna for the first communication system; and a ground pattern that is electrically grounded and is formed on the substrate to extend in both of the longitudinal direction and the vertical direction of the vehicle body, wherein the antenna for the first communication system extends only in one direction;

the inside orthogonal antenna extends only in another direction, which is orthogonal to the one direction; and a feeding point for the inside orthogonal antenna is connected to the inside orthogonal antenna and the ground pattern.

12. The antenna unit according to claim 11, wherein each of the antenna for the first communication system and the inside orthogonal antenna is an element of a monopole antenna, and the element of the antenna for the first communication system and the element of the inside orthogonal antenna are disposed in directions along the substrate.

13. The antenna unit according to claim 12, wherein the element of the antenna for the first communication system extends in the vertical direction, and the element of the inside orthogonal antenna extends in the longitudinal direction of the vehicle body.

14. An antenna unit comprising:

a case configured to be disposed on an upper surface of a vehicle body;

a substrate disposed in the case and disposed along a longitudinal direction and a vertical direction of the vehicle body;

an antenna configured for a first communication system and disposed on the substrate;

an inside orthogonal antenna configured for a polarization diversity communication system used for a second communication system and disposed on the substrate such that a main radiation polarization plane of the inside orthogonal antenna is orthogonal to a main radiation polarization plane of the antenna for the first communication system; and a ground pattern that is electrically grounded and is formed on the substrate to extend in both of the longitudinal direction and the vertical direction of the vehicle body, wherein the antenna for the first communication system extends in a first one direction;

the inside orthogonal antenna extends in a second direction, which is orthogonal to the first direction;

the inside orthogonal antenna does not extend in the first direction; and a feeding point for the inside orthogonal antenna is connected to the inside orthogonal antenna and the ground pattern.

15. The antenna unit according to claim 14, wherein each of the antenna for the first communication system and the inside orthogonal antenna is an element of a monopole antenna, and the element of the antenna for the first communication system and the element of the inside orthogonal antenna are disposed in directions along the substrate.

16. The antenna unit according to claim 15, wherein the element of the antenna for the first communication system extends in the vertical direction, and the element of the inside orthogonal antenna extends in the longitudinal direction of the vehicle body.

* * * * *